United States Patent [19]

Conti

[11] 3,938,355

[45] Feb. 17, 1976

[54] METHOD OF KNITTING A PLURALITY OF CONVERGENT TUBULAR PORTIONS AND RESULTING ARTICLE

[75] Inventor: Paolo Conti, Florence, Italy

[73] Assignee: Billi, S.p.A., Florence, Italy

[22] Filed: Aug. 10, 1973

[21] Appl. No.: 387,515

[30] Foreign Application Priority Data

Aug. 12, 1972 Italy ..... 9641/72
Nov. 16, 1972 Italy ..... 9758/72

[52] U.S. Cl. ..... 66/95; 66/177; 66/187
[51] Int. Cl.[2] ..... D04B 9/42; A41B 9/00
[58] Field of Search ..... 66/96, 176, 177, 26, 187, 66/173

[56] References Cited

UNITED STATES PATENTS

| | | | |
|---|---|---|---|
| 1,282,958 | 10/1918 | Scott | 66/95 X |
| 2,223,808 | 12/1940 | Rambo | 66/173 |
| 2,747,390 | 5/1956 | Reymes-Cole | 66/173 |
| 3,254,509 | 6/1966 | Tenconi | 66/173 X |
| 3,340,706 | 9/1967 | Currier | 66/26 |
| 3,800,563 | 4/1974 | Billi | 66/95 |

FOREIGN PATENTS OR APPLICATIONS

| | | | |
|---|---|---|---|
| 2,002,704 | 7/1970 | Germany | 66/173 |
| 2,034,010 | 1/1971 | Germany | 66/9 R |
| 750,166 | 6/1956 | United Kingdom | 66/173 |

OTHER PUBLICATIONS

Goadby, The Hosiery Trade Journal, June 1973, Vol. 80, No. 954, pp. 99 and 100.

*Primary Examiner*—W. Carter Reynolds
*Attorney, Agent, or Firm*—Clifton T. Hunt, Jr.

[57] ABSTRACT

The invention is a process for knitting a plurality of convergent tubular portions on a circular knitting machine having a dial and cylinder and the resulting article, especially the two legs and body portion of a panty-hose, wherein the knitting operation is continuous with no sewing of separate pieces together, and the height of the body portion may be varied without dependency on the needle cylinder diameter which also includes a crotch closure.

12 Claims, 24 Drawing Figures

METHOD OF KNITTING A PLURALITY OF CONVERGENT TUBULAR PORTIONS AND RESULTING ARTICLE

BACKGROUND OF THE INVENTION

Panty-hose have heretofore been manufactured by sewing together two separate portions, each comprising a leg and one-half of the body portion. The resulting garment has the advantage of providing a comfortable fit but has the disadvantage of requiring the separate step of sewing together the two portions after they are knit and removed from the knitting machine.

It is also known to knit a one-piece panty-hose wherein the entire garment is knit in its completed form on the knitting machine as, for example, in U.S. Pat. No. 3,673,821 to Johnson. This one-piece panty-hose has the advantage of economy of manufacture but has the disadvantage of not providing as comfortable a fit as the two-piece panty-hose, because the depth of the body portion from waist to crotch is limited by the diameter of the knitting cylinder.

It is therefore an object of this invention to provide a method of making a one-piece panty-hose wherein the garment is completed on the knitting machine and wherein the crotch of the body portion is spaced walewise from the waist opening and thereby providing any desired depth between the waist band and crotch and a consequent comfortable fit.

The process, according to the invention, has the object of setting up and completing the article directly on the machine, without any subsequent work, and without any mechanical transformation, but only with an appropriate arrangement of program for the selection of needles and dial hooks according to their present capability in existing machines, and can be easily carried out by those skilled in the art in accordance with the invention.

The process, according to the invention, substantially includes: first, the forming on the knitting needles of a short length of a first tubular fabric preparatory to forming a crotch closure (similar to the closure of the toe of a tubular article as described, for example, in U.S. Pat. Nos. Re.26,580 and 26,581 to John W. Currier, or in Italian Pat. Nos. 814,164 and 837,903 to Arrigo Micheletti). After the closure is formed as by twisting the fabric or constricting it with a thread according to the cited patents, or otherwise closed, and while the terminal course of the closure fabric is being knit dial hooks are projected to receive the loops of yarn in the terminal course until subsequently transferred onto the needles at an appropriate time. The forming of a second tubular fabric is then carried out with all the needles, during which the said closure is partially transferred from the dial hooks to the needles along a first segmental arc to join the stiches of a first segment of said closure with the stiches of a corresponding first segment of said second tubular fabric preparatory to forming a terminal course and casting off the second tubular fabric from the needles in said first segmental arc.

A third tubular fabric is formed on all the needles and as a partial continuation of the second tubular fabric by those needles outside the first segmental arc and defining a residual arc of the cylinder. During knitting of the initial course of the third tubular fabric the dial hooks are projected to receive the loops of yarn along the first segmental arc and knitting of said third tubular fabric continues to form a pouch between the needles and the dial hooks along said first segmental arc and in convergence with the second tubular fabric by the needles along the residual arc. The knitting of the third tubular fabric terminates in a welt which may be elasticized to form a waistband, after which the third tubular fabric is cast off all the needles, whereby said third tubular fabric remains engaged to the second tubular fabric along an arc of stitches corresponding to the residual arc, and to the dial hooks along said first segmental arc.

The closure is transferred from the dial hooks along said residual arc onto the respective needles and the third tubular fabric is transferred from the dial hooks along said first segmental arc onto the respective needles, and the needles are activated circumferentially to form a fourth tubular fabric which converges with the third tubular fabric along the first segmental arc and converges with the closure along the residual arc.

The first tubular fabric may define the crotch closure of a panty-hose, while the second and fourth tubular fabrics may define the two legs of a panty-hose, and while the third tubular fabric may define the body portion and waistband.

The second and fourth tubular fabric may be formed with a closure for the toe, the second tubular fabric prior to its forming, and the fourth tubular fabric at the end of its forming. For the purpose of avoiding ladders along the second tubular fabric, or otherwise, the first step in practicing the invention, if the toe portion of the second tubular fabric is to be closed on the machine is to form a closure for the second tubular fabric on a first group of needles which may be alternate needles around the cylinder. The terminal course of this toe closure is retained by said first group of needles while the first tubular fabric is knit with the remaining needles sufficient to form with the dial hooks a two-ply crotch closure. The dial hooks are projected during knitting of the initial course of said first tubular fabric to receive said initial course of the first tubular fabric or crotch closure. Then, the knitting of the second tubular fabric is begun with all the needles, thereby engaging said toe closure on the first tubular fabric.

According to another development of the invention provisions are made so that the crotch or crotch closure comprises two plies each of which may be formed from different yarns. It is contemplated to make the inner ply, that is the ply which is inside when the garment is worn, of a yarn with characteristics different than those of the yarn from which the outer ply is made.

More specifically, one may form the inner ply with a yarn which will define a fabric offering comfort in contact with the epithelium, while the outer ply may be formed with a yarn offering aesthetic requirements to the completed fabric, as it is visible. The juncture of the two plies desirably corresponds with the constricted area of the fabric to form the crotch closure.

The inner ply may for example, be made of cotton yarn and the outer one of synthetic yarn. With the use of selective color agents, the fabric dyeing may be such as not to affect the inner ply which may remain, for instance, white or of a color different than that of the remaining fabric.

In the drawings:

FIGS. 1 and 2; 3 and 4; 5 and 6; 7 and 8; 9 and 10; 11 and 12; 13 and 14 schematically illustrate, in pairs, sequential working stages, with the odd-numbered figures showing the cylinder in section, and with the evennumbered figures showing a schematic perspective view, in some of which the cylinder is separated from the dial hooks for clarity of understanding;

FIGS. 15 and 16 perspectively illustrate the fabric as it comes out of the machine and in the final array;

Figure 23:
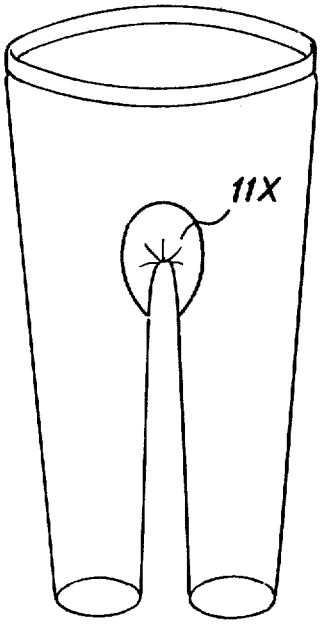
Figure 24:
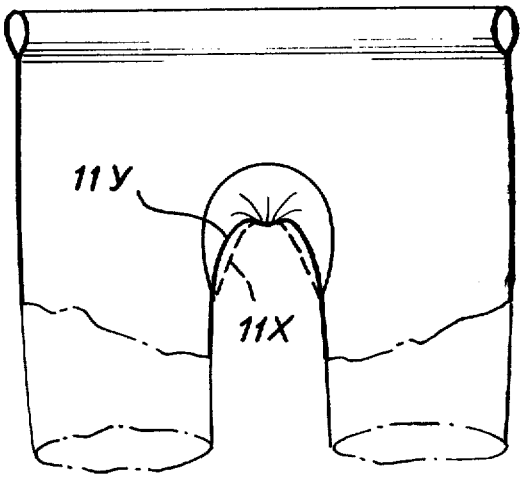

FIGS. 23 and 24 diagrammatically illustrate the finished fabric.

In FIGS. 1 to 20 reference numeral 1 (1E and 1W) denotes a schematic representation of the knitting needles in a conventional circular knitting machine having a dial and cylinder. 3 denotes the vaccuum take-down which extends coaxial to the needle cylinder and in which the fabric being formed is pneumatically attached and tensioned. The dial above the needle cylinder is generally indicated at 5 and its transfer hooks 7 (7E, 7W) are radially movable. For convenient reference in the following description, X-Y indicates a common diameter of the two working circumferences of the hooks and needles. Said diameter X-Y divides the hooks circumference 7 into a segmental arc X E Y on the right hand of the diameter X-Y looking at the drawing, and into a segmental arc X W Y on the left of the diameter X-Y looking at the drawing. Correspondingly in the arc XEY the needles are indicated by 1E and the hooks by 7E, while in the arc X W Y the needles and the hooks are indicated by 1W and 7W.

The motion of the needles and hooks is carried out by conventional means with which those skilled in the art will be conversant to obtain the controls and functions hereinafter indicated. Known means are also used to provide the closures for the toes of the legs and for the other purposes indicated in the following description.

Figure 18:
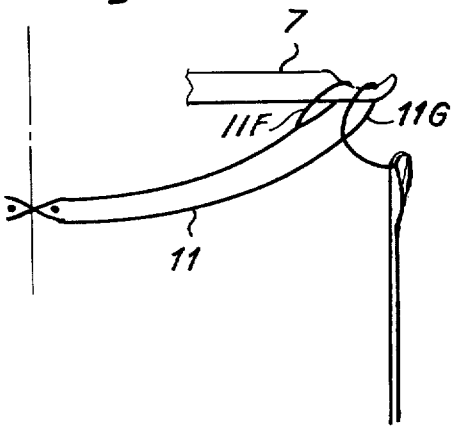
FIGS. 18, 19 and 20 illustrate an arrangement of parts in making a welt for the waistband of a pantyhose.
Figure 19:
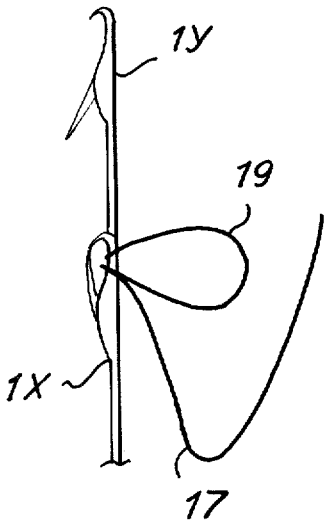
Figure 20:
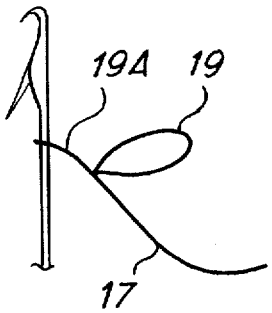
Figure 21:
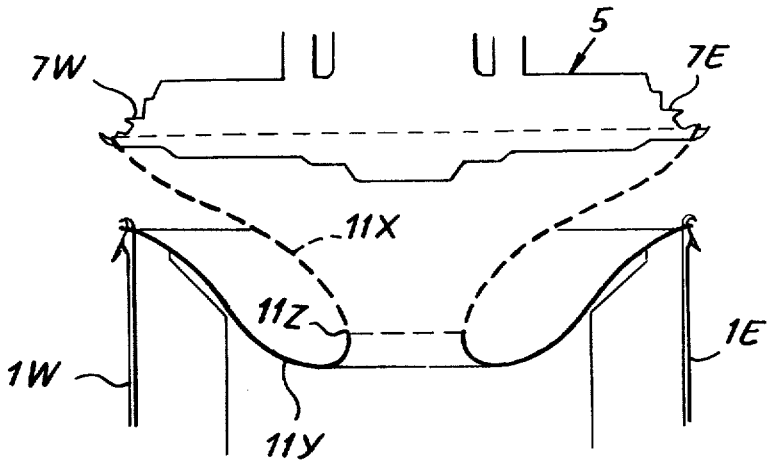
FIG. 21 illustrates the use of different yarns in knitting the first tubular fabric to be constricted so as to form a double layer crotch closure.
Figure 22:
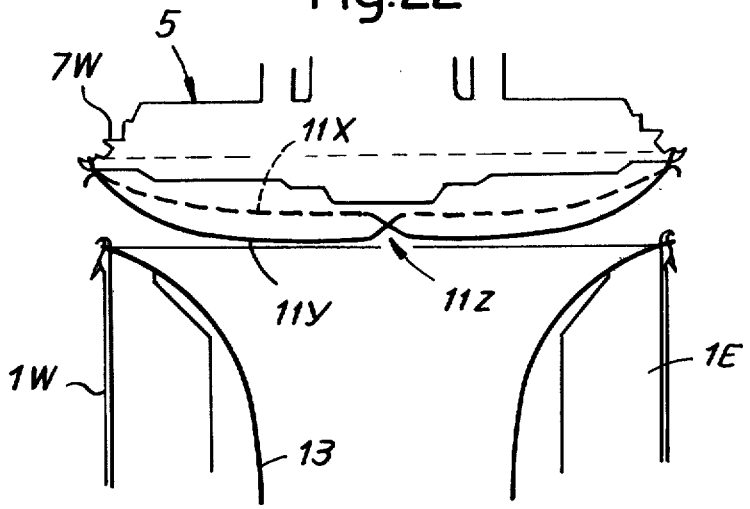
FIG. 22 illustrates the array wherein the crotch closure is already completed and supported on the dial hooks while second tubular fabric is formed.

As shown in the drawings, and particularly FIGS. 1, 2, 21 and 22 there is first knit on selected needles 1 spaced circumferentially around the needle cylinder a first tubular fabric of a length sufficient to form a closure 11 according to any one of the already known systems used for closing the toe of a stocking such as described in said Currier and Micheletti patents. In making the closure 11, which is destined to become the crotch closure if the article is a panty-hose, an annular pocket of fabric is formed between the hooks 7 and the needles 1 (FIG. 21). This is accomplished by knitting a length of fabric to a length at least twice the radius of the needle cylinder after the dial hooks are advanced to engage yarn during the formation of the initial course of closure 11, preparatory to constricting the center of the pocket in a known manner as by constricting the pocket at the cylinder axis with a binding thread or with a relative rotation between the cylinder and dial to form first and second plies of the closure 11. Then the circumferential edges of the two plies are united on the dial hooks 7 by projecting the dial hooks to receive the stitches 11G in the terminal course of closure 11 from the needles, it being understood that the first ply is already held on the hooks 7 by the stitches 11F of the initial course in closure 11 (FIG. 18). Immediately thereafter an end flap or anti-ravel tab 11A is formed between the hooks and the needles, then discontinuing the yarn feed and pressing the fabric off the needles.

Selected needles such as, but not limited to, alternate needles around the circumference then begin knitting the toe portion and thereafter the remainder of a second tubular fabric 13 (FIGS. 3 and 4), continuing through the thigh portion to constitute the first of the two legs (if the article is a panty-hose), preparatory to joining the leg 13 to the crotch closure 11. The crotch closure 11 and the tubular fabric 13 are independent up to this point.

Figure 6:
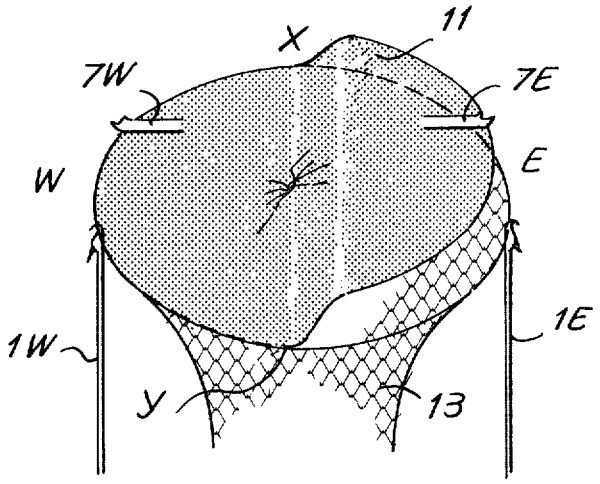
Figure 7:
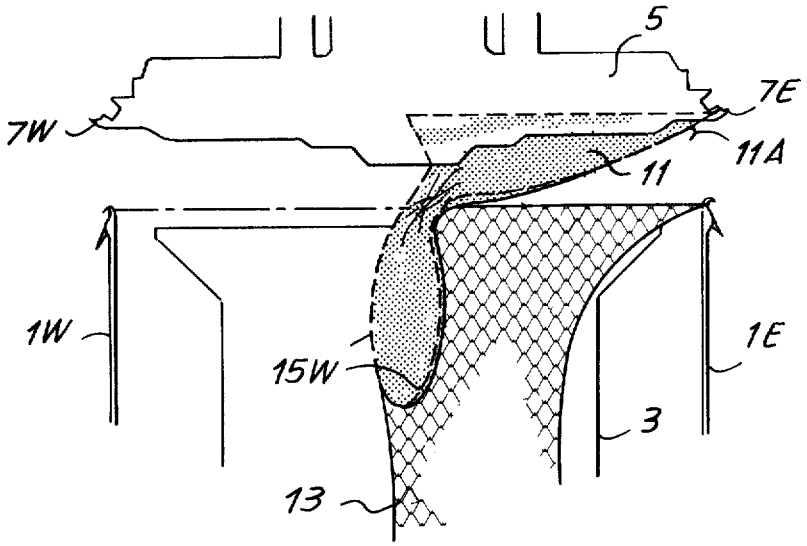
Figure 8:
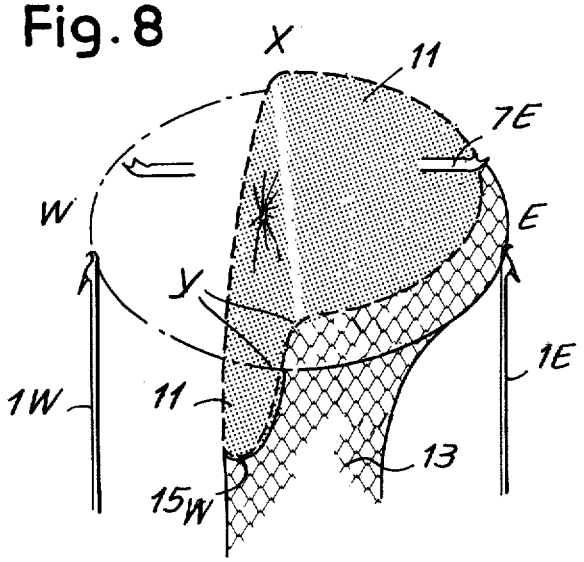
Figure 9:
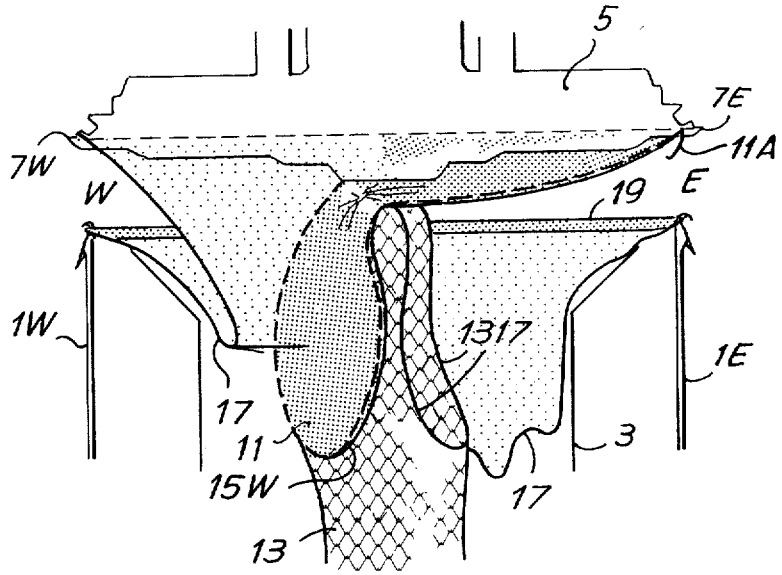

A first continuous segment of loops from the terminal edge of the closure 11 corresponding to the arc X W Y in FIG. 6 is transferred from the hooks 7W to the needles 1W (FIGS. 5 and 6), while a second segment of loops which form the remainder of the terminal edge of closure 11 in the arc X E Y remains engaged by the hooks 7E. Then, with a few courses of knits, the fabric 13 and the closure 11 are connected in correspondence of the stitches formed by the needles 1W, that is, along the arc X W Y, which after a final flap or anti-ravel tab 15W is formed coextensive with arc X W Y formed by the joined fabric held on needles 1W. Under these conditions (see FIGS. 7 and 8) the needles 1W and the hooks 7W are then freed by pressing off tab 15W from the needles of arc XWY, while the needles 1E retain the stitches in the remaining circumferential edge of the fabric 13, and the hooks 7E still retain the remaining circumferential edge of the closure 11 along the arc X E Y.

Figure 10:
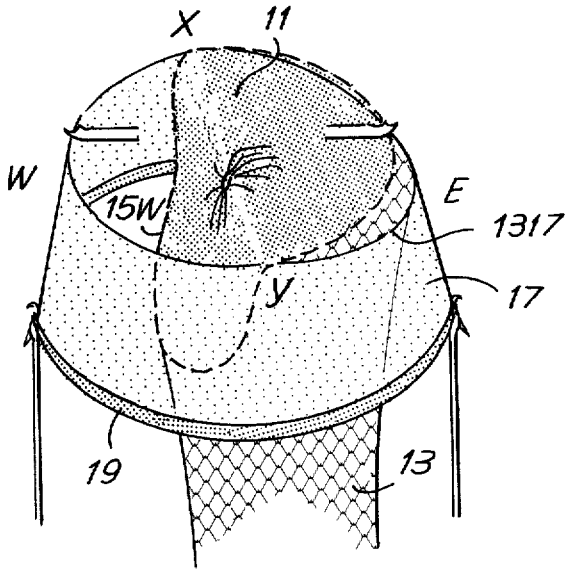

Next, a third tubular fabric 17, destined to become the body portion (if the article is a panty-hose) is knit on all the needles or on selected needles, such as, but not limited to, alternate needles around the circumference of the cylinder. The dial hooks are projected along the arc X W Y to receive the initial course of tubular fabric 17 as knit from the needles 1W and the fabric 17 is supported by the hooks 17 along the arc X W Y as knitting of tubular fabric 17 continues to define half of an annular pocket or sack between the hooks 7W and the needles 1W. Meanwhile, the remainder of the circumference of the fabric 17, along the arc X E Y, is initially joined by the needles 1E to the retained loops of the second tubular fabric 13 to form a segmental course indicated at 1317 in FIGS. 9 through 15. In FIG. 10, the knitted tubular fabric 17 is shown extended above the knitting needles 1W, 1E solely for the purpose of illustrating the array of the fabric after completion of the second tubular fabric, it being understood that the fabric 17 depends from the needles 1W, 1E in actual practice, except for that segment support by dial hooks 7W at this stage.

Knitting of the tubular fabric 17 for the forming of the body portion continues until a sufficient amount of fabric is formed to provide the desired depth between the waist opening and the crotch of the completed panty-hose. Knitting of fabric portion 17 ends for a panty-hose at the waist opening with a tubular sheath 19 capable of accommodating an elastic. Said tubular sheath 19 may be made like a conventional welt, but in smaller dimensions and also using an elastic yarn, so as to be suitable for use as an elastic waistband. The tubular sheath 19 is manufactured (see FIGS. 18 and 19) by keeping selected needles 1X low and inactive to retain the fabric 17. The residual needles 1Y, desirably interspersed among the inactive ones 1X, knit an annular pocket and thus the sheath 19. The sheath is closed and made tubular by activating all the needles and forming therewith the final flap or anti-ravel tab 19A. The fabric 17, 19, 19A is pressed off the needles after the forming of said final flap 19A (see FIG. 11).

Figure 11:
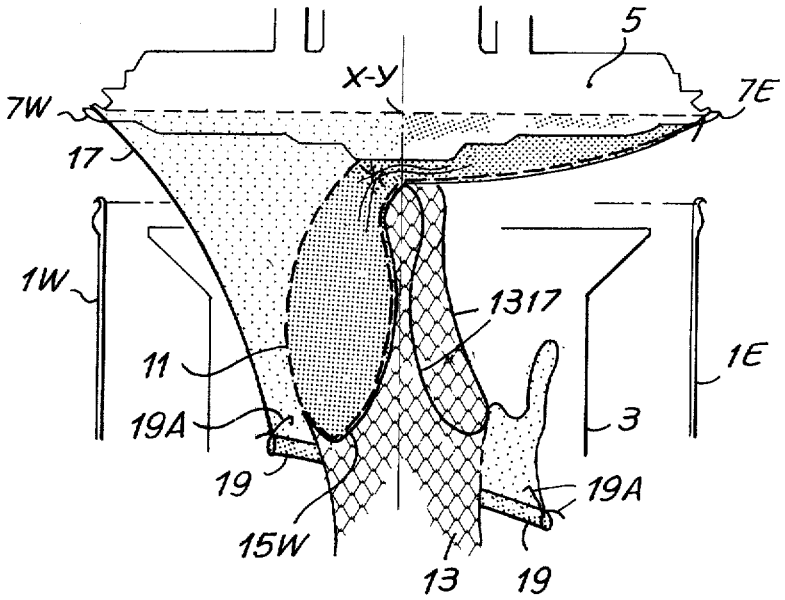
Figure 12:
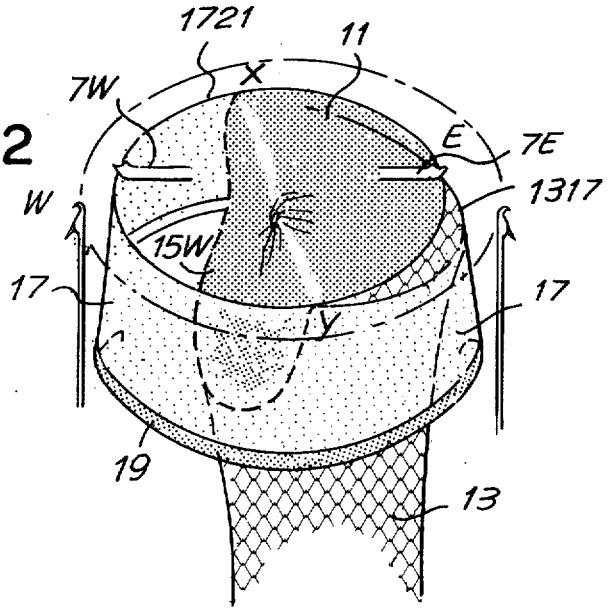
Figure 13:
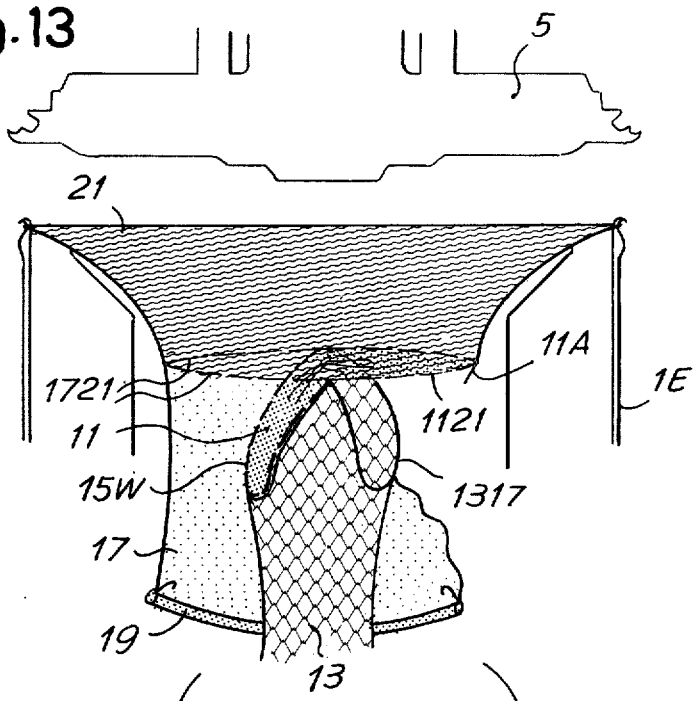
Figure 14:
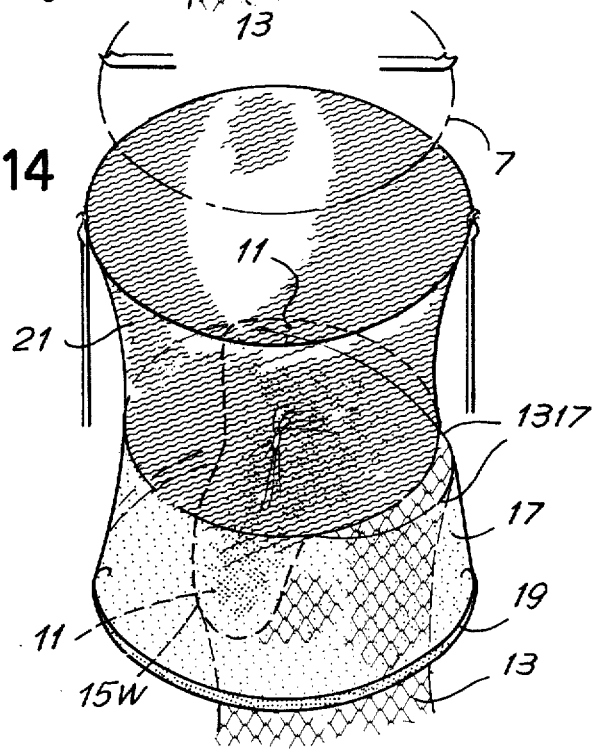

There is thus attained the array shown in FIGS. 11 and 12, wherein the hooks 7W retain a segmental portion 1721 of the initial course of the fabric portion 17. The other segment of the initial course of fabric portion 17 is that denoted at 1317, where the fabric portion 13 converges with the fabric portion 17. The needles 1E, 1W are free, while the hooks 7E still engage the segment of the closure 11 corresponding to the arc X E Y.

Next, the segment of the closure 11 supported by the dial hooks 7E along the arc X E Y is transferred from the hooks 7E to the needles 1E and the initial course of the segment of the fabric 17 supported by the hooks 7W is transferred to the needles 1W, and knitting is begun on all needles to form a fourth tubular fabric 21 in which the initial course thereof is concatenated with the transferred segment of closure 11 and fabric 17. The initial course of said fabric 21 is defined by the stitches of the segmental course 1721 and by the stitches of the segmental course 1121, which, respectively, join the second leg portion 21 to the body portion 17 and to the crotch portion 11. Knitting of the tubular fabric 21 is then continued to the completion of the second leg, after which the completed panty-hose is pressed-off the machine.

Figure 1:
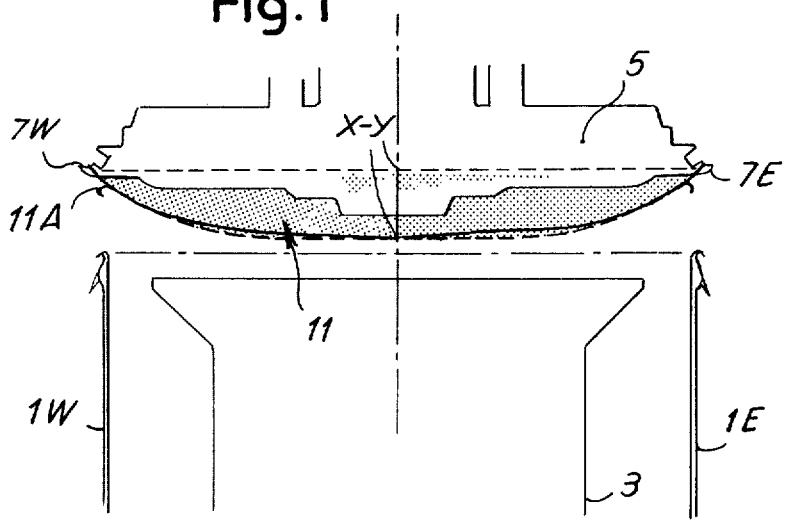
Figure 2:
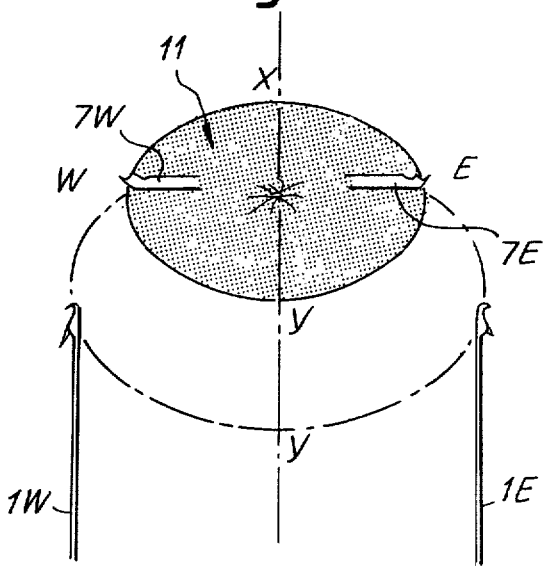
Figure 3:
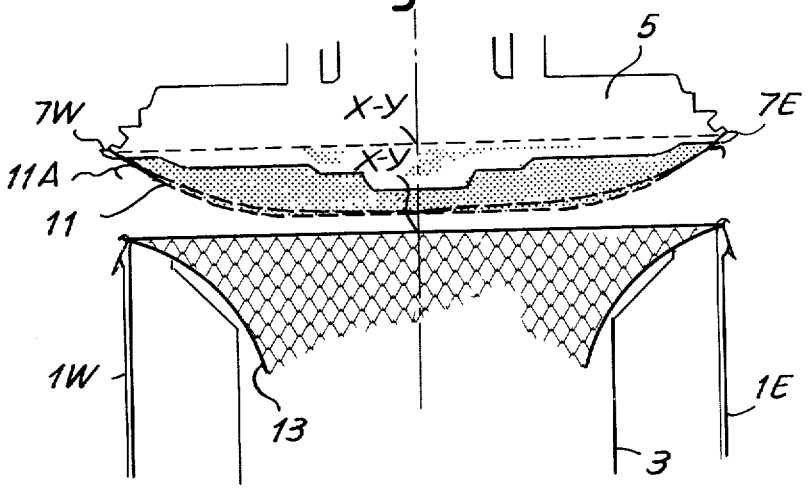
Figure 4:
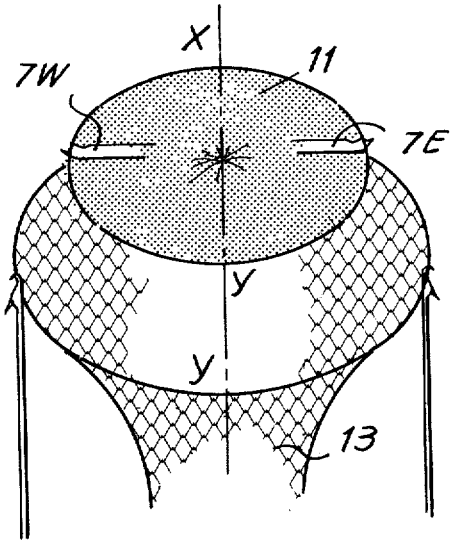
Figure 5:
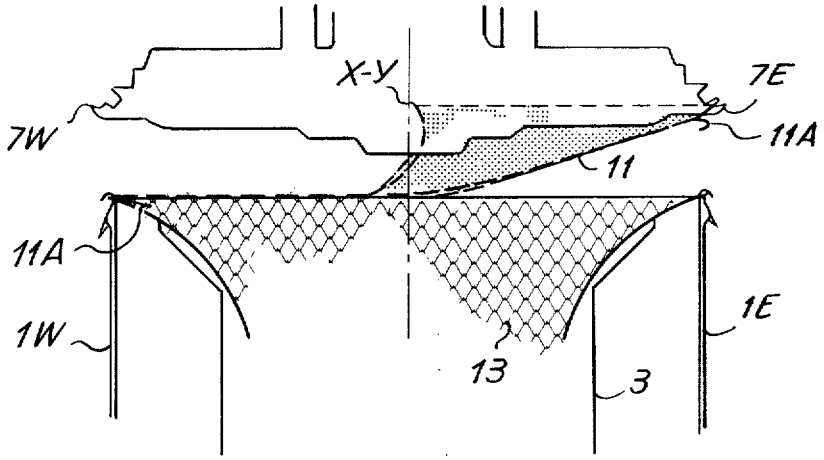

It is, of course, optional whether to close the toes of the leg portions 13 and 21 on the machine. They may be closed as a separate operation after the panty-hose leaves the machine, or they may be closed on the machine according, for example, to the teachings in said Currier and Michelletti patents. When it is desired to close the toes on the machine, this may be accomplished by proceeding in the following manner (see FIG. 17). A first closure 201 destined to close the toe of the first tubular fabric or leg 13 is formed in accordance with the desired one of the aforesaid patents. This closure 201 is preferably made with a part of the needles, for instance, with a half of the 1:1 selected needles along the needle circumference. The closure is formed with the aid of the hooks 7 and with the wrapping technique of the Michelletti patent or the twist system of the Currier patents. The needles by which the closure 201 is formed are designated at 203 in FIG. 17. The closure 201 is retained by a portion of the needles, preferably the needles 203 which have formed it. The free needles (for instance, the needles 205) are activated to knit a second closure 207 which corresponds to the closure 11 in the previous explanation. The second closure 207 is also made with the aid of the hooks 7 and during knitting of the terminal course of the final flap or anti-ravel tab corresponding to that shown at 11A in the previous explanation, the dial hooks 7W, 7E are projected to receive that terminal course (FIG. 1). If the closure 201 is to be used to close the toe of the leg portion 13, toe closure 201 will be supported on selected needles beneath the hook-supported crotch closure 11 in FIG. 1. Then knitting proceeds on all the needles to form the tubular fabric of the first leg, corresponding to the tubular fabric 13 previously described. This tubular fabric 13 initiates with a connection to its toe closure 201, thus providing a so-called closed toe for the first leg at one end of the tubular fabric 13. The toe of the second leg is closed after the forming of the tubular fabric for the second leg, defined by fabric portion 21.

Figure 15:
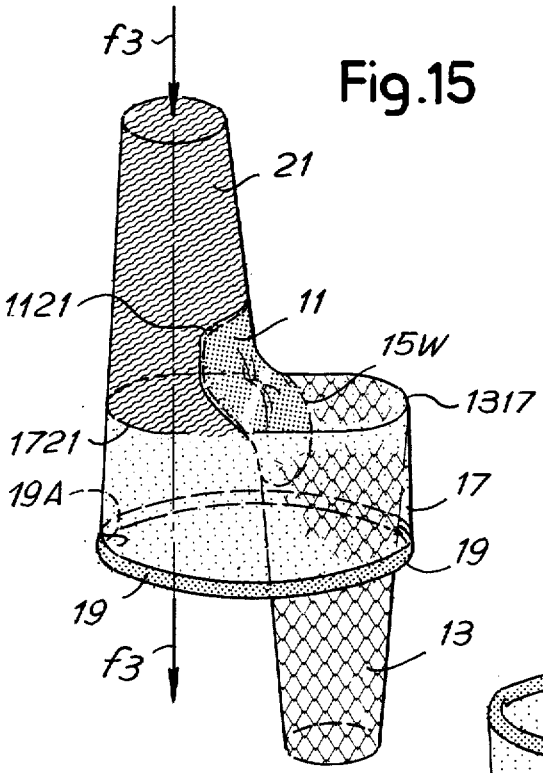
Figure 16:
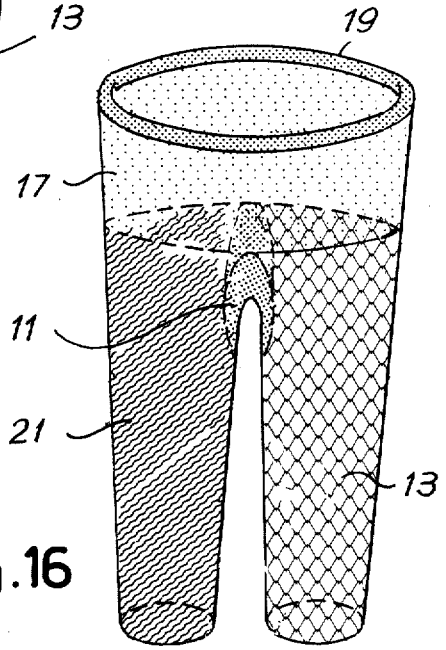
Figure 17:
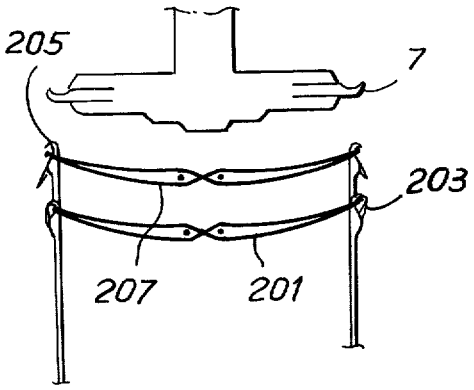
FIG. 17 illustrates one way to effect the closure of the first fabric.

The panty-hose is pressed off from the machine in the array shown in FIG. 15, and regardless of whether the toes are closed on the machine, the tubular fabric 21 may be inverted in the direction of the arrow $f_3$ of FIG. 15 (in which it leaves the machine) to the array of FIG. 16. The article may alternatively, if desired, be arrayed to the condition of FIG. 16 by inverting the fabric 13, instead of the fabric 21. The crotch closure 11 is located — in any case — at the crotch of the article. Some of the end flaps or anti-ravel tabs are visible and others remain inside regardless of which leg is inverted.

The process of forming the crotch closure 11 is as has been already described, with the fabric being formed between the needles 1E and 1W of the cylinder 3 and the hooks 7E and 7W of the dial plate 5. There is, however, a specific embodiment of the constricted closure which is particularly adapted for use with this invention. As shown in FIGS. 12–24, the crotch closure 11 may comprise a first length of knitted fabric 11X (shown in dotted lines in FIGS. 21 and 22 as extending substantially to the axis of the cylinder) and formed with a yarn of the same type as that with which the portions of the panty-hose other than the crotch are made. A yarn change is then made and knitting continued to provide a continuing length of fabric 11Y (shown in solid lines in FIGS. 21 and 22). The two lengths 11X and 11Y of fabric are substantially equal and the yarn change occurs at a point 11Z at or adjacent the cylinder axis which corresponds to the constricting zone of the tubular fabric for the forming of the two-ply closure 11.

The layer 11X is intended to be the outer ply in the worn fabric and thus it will advantageously have the same texture and appearance and also advantageously the same color as the fabric portions which form the legs 13 and 21 and the body portion 17. Conversely, the fabric 11Y is intended to be the inner ply of the garment when worn, and thus is not visible. The fabric of the ply 11Y may then be formed of a yarn having characteristics and a color more suitable for its intended us. Specifically, for example, this inner fabric ply 11Y may be formed of cotton and its original white color may be preserved by the use of selective coloring agents, which act on the synthetic yarns forming the rest of the garment but not on the cotton of the inner ply 11Y. The change of the yarn in the zone 11Z will be effected in such a manner as to obscure from the outside the visibility of the inner ply 11Y and to obscure from the inside the visibility of the outer ply 11X.

With the crotch closure 11 made in the abovementioned manner, it is possible to comfortably wear the garment without the presence of an inner initimate garment.

In the drawings and specifications, there has been set forth a preferred embodiment of the invention and although specific terms are employed they are used in a generic and descriptive sense only and not for purpose of limitation, the scope of the invention being defined in the following claims:

I claim:

1. A process of knitting on a circular knitting machine having a needle cylinder and a dial plate with hooks, said method comprising the steps of knitting a first tubular portion on first selected needles spaced circumferentially around the needle cylinder, projecting the dial hooks to receive the first tubular portion, supporting the first tubular portion on said dial hooks, knitting a second tubular portion on second selected needles spaced circumferentially around the needle cylinder, transferring a first continuous segment of the stitches of said first tubular portion from said hooks to corresponding ones of said needles while retaining a second segment of the stitches of said first tubular portion on said hooks, joining said first segment of transferred stitches from said first tubular portion to the corresponding arc of said second tubular portion, knitting an anti-ravel tab conextensive with the arc of said first segment, pressing off from the knitting needles the anti-ravel tab between said first and second tubular portions, knitting an initial course of a third tubular portion on third selected needles spaced circumferentially around the needle cylinder, projecting a segment of the dial hooks to receive a segment of said initial course of the third tubular portion from a corresponding segment of the knitting needles and then continuing knitting said third tubular portion on all of said third selected needles spaced circumferentially around the needle cylinder until said third tubular portion reaches a desired length, pressing off the terminal course of said third tubular portion on the knitting needles, transferring the segment of stitches in said initial course of the third tubular fabric from the dial hooks to a corresponding segment of the knitting needles, transferring said second segment of stitches of said first tubular portion from the dial hooks to a corresponding segment of said knitting needles, and knitting a fourth tubular portion on all of said knitting needles spaced circumferentially around the cylinder.

2. Process as in claim 1, characterized in that the second and fourth tubular portions converge with the third and first tubular portions to define respectively, the two legs, the body portion and the crotch closure of a panty-hose.

3. Process as in claim 2, characterized in that the third tubular portion terminates in a tubular annular sheath and an anti-ravel tab knit prior to said terminal course thereof.

4. Process as in claim 2, characterized in that the second and fourth tubular portions each include a toe closure, the toe closure in the second tubular portion being formed before knitting the second tubular portion, and the fourth tubular portion being formed at the end of knitting the fourth tubular portion.

5. Process as in claim 2, characterized in that: a toe closure is formed for the second tubular portion and it is retained on a first group of alternate needles; that then a crotch closure is formed with the residual group of intervening needles, then said crotch closure is transferred to the dial hooks; and then knitting of the second tubular portion is begun with all the needles, thereby joining said toe closure to the second tubular portion.

6. Process as in claim 2, characterized in that the first tubular portion is developed into a crotch closure by knitting it to a length at least twice the radius of the needle cylinder after the initial course of the first tubular portion has been received on the dial hooks and then constricting the first tubular portion about the axis of the cylinder, then transferring said terminal course of the first tubular portion from the cylinder needles to the dial hooks, then knitting an anti-ravel tab between the dial hooks and cylinder needles, and then clearing all the needles.

7. Process as in claim 6, characterized in that the first tubular portion is developed into first and second plies after its said terminal course is transferred to the dial hooks, said first ply extending from the initial course on the dial hooks to the point of constriction and the second ply extending from the point of constriction to the dial hooks.

8. Process as in claim 7, wherein a first yarn is used to knit said first ply and wherein a second yarn having different characteristics from said first yarn is used to knit said second ply.

9. Process as in claim 8, characterized in that the point of yarn change coincides with the point of constriction at the axis of the cylinder.

10. Process as in claim 8 characterized in that the yarn from which one of said plies is formed results in a fabric offering comfort when in contact with the epithelium, and the yarn from which the other ply is formed results in a fabric offering aesthetic qualities.

11. Process as in claim 10, characterized in that synthetic yarn is used to form said one ply and cotton yarn is used to form said second ply.

12. A method of knitting pantyhose on a circular knitting machine having a needle cylinder, knitting needles, a dial and radially movable transfer hooks supported in said dial, said method comprising knitting an initial course of a first tubular fabric portion on said knitting needles while projecting said dial hooks to receive said initial course, knitting additional courses in said first tubular fabric portion equal to substantially twice the radius of the needle cylinder, constricting said fabric portion at the axis of the needle cylinder, transferring said initial course of said first tubular fabric portion waistband of said panty-hose, pressing off from all needles said third tubular portion, transferring said remaining segment of said initial course of the third tubular fabric portion from the dial hooks to a corresponding segment of the knitting needles, transferring the residual segment of the closure from the remainder of said dial hooks to the corresponding arc of knitting needles, knitting on all needles an initial course of a fourth tubular fabric portion, concatenating said initial course of the fourth tubular fabric portion with the said transferred courses of said third tubular fabric portion and said closure, and continuing knitting on all the needles to the terminal course in the foot portion of said fourth tubular fabric portion, and pressing off all the needles.

* * * * *